United States Patent [19]

Latva

[11] 4,028,100

[45] June 7, 1977

[54] HEAT TREATING ATMOSPHERES

[75] Inventor: Henry F. Latva, Dearborn, Mich.

[73] Assignee: Chrysler Corporation, Highland Park, Mich.

[22] Filed: Oct. 15, 1974

[21] Appl. No.: 514,352

Related U.S. Application Data

[62] Division of Ser. No. 361,082, May 17, 1973, Pat. No. 3,891,473.

[52] U.S. Cl. ..... 75/224; 148/126
[51] Int. Cl.[2] ..... B22F 9/00; C21P 1/76
[58] Field of Search ..... 75/224; 148/126, 16.7, 148/16, 16.5

[56] References Cited

UNITED STATES PATENTS

| | | | |
|---|---|---|---|
| 2,299,138 | 10/1942 | Gier | 148/16.5 |
| 2,489,839 | 11/1949 | Whitney | 148/16.5 |

FOREIGN PATENTS OR APPLICATIONS

| | | | |
|---|---|---|---|
| 647,278 | 12/1950 | United Kingdom | 75/224 |

OTHER PUBLICATIONS

Goetzel, C., Treatise on Powder Metallurgy, vol. 1, pp. 636–646, 1944, Interscience, N.Y.

Jenkins, I., Controlled Atmospheres for the Heat Treatment of Metals, Chapman & Hall, London, 1946, pp. 8–24.

Metals Handbook — 1948 Ed., ASM, 1948, pp. 294–298.

*Primary Examiner*—Richard E. Schafer
*Attorney, Agent, or Firm*—Talburtt & Baldwin

[57] ABSTRACT

A heat treating atmosphere and method for its use wherein the atmosphere provides precise control over carbon content in metal parts, such as steel, and which is particularly applicable to powder metal sintering. The method uses a mixture of resultant constituents from dissociated ammonia and methane combusted with air to provide an atmosphere of controlled carbon potential. The ammonia is dissociated, the methane is combusted with air and the resultant constituents are mixed together prior to introduction into the heat treating furnace. The method prevents the formation of undesirable hard and brittle phases of carbides during sintering, the resulting products being free of segregated high carbon constituents, i.e., cementite, and being easier to machine, thus providing much longer cutting tool life.

20 Claims, 1 Drawing Figure

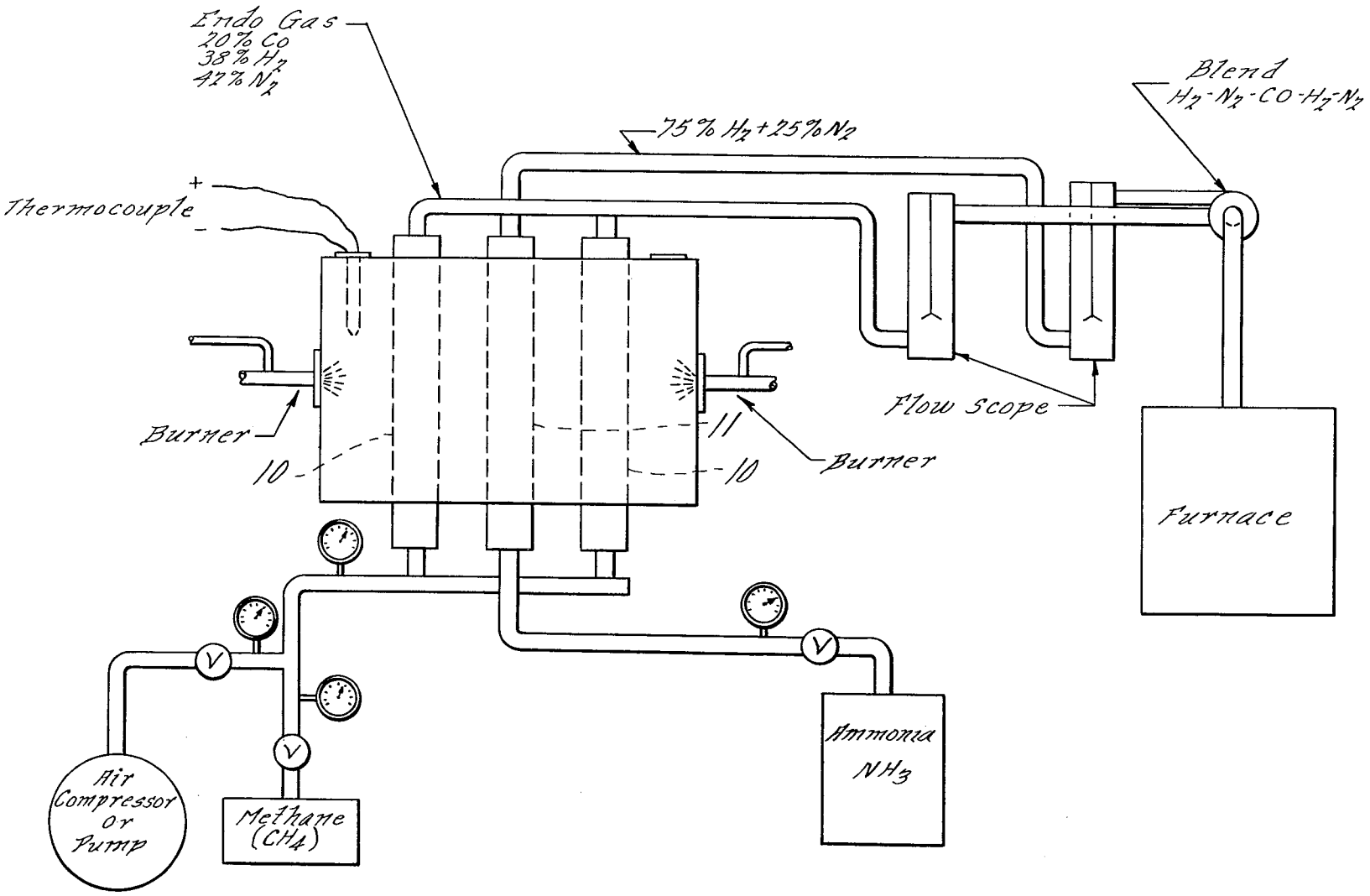
Blend
$H_2$-$N_2$-CO-$H_2$-$N_2$
Furnace
Flow Scope
Burner
Ammonia
$NH_3$
75% $H_2$+25% $N_2$
11
10
Endo Gas
20% CO
38% $H_2$
42% $N_2$
+
-
Thermocouple
Burner
10
Methane
($CH_4$)
Air
Compressor
or
Pump

HEAT TREATING ATMOSPHERES

This is a division of application Ser. No. 361,082 filed May 17, 1973, now U.S. Pat. No. 3,891,473.

BACKGROUND

The prior art discloses heat treatments wherein ammonia and methane combusted with air are mixed together in a furnace to provide heat treating atmospheres. However, this differs from the subject use of dissociated ammonia because in the prior art processes the ammonia is dissociated in the furnace whereas in the subject method the ammonia must be dissociated prior to its introduction into the furnace or other heat treating environment. In the prior art, dissociation of the ammonia in the furnace provides nascent nitrogen which nitrides the workpiece undergoing treatment whereas in the subject method dissociation prior to introduction to the furnace provides molecular $N_2$ which is inert and does not effect the workpiece undergoing treatment.

SUMMARY

Dissociation of ammonia provides $N_2$ and $H_2$. The combustion of methane with air provides CO, $N_2$ and $H_2$. The diluting of the combusted methane products by the ammonia products makes possible the provision of a heat treating atmosphere wherein predetermined and very small amounts of CO are present and therefore precise control of the carbon content of a workpiece exposed at elevated temperatures can be achieved.

It is desirable to have more precise control over the carbon content of materials such as steel, iron and the like. Generally, this can include any carbide forming composition. Precise control is obtained according to this invention by diluting a carbiding atmosphere formed from methane combusted with air and with a diluent of anhydrous ammonia which is dissociated into $N_2$ and $H_2$ prior to its being mixed with the combusted or cracked methane and prior to the introduction of the blended constituents into the furnace. It is important to this invention that the ammonia be dissociated prior to its introduction into the furnace. Otherwise, when dissociation occurs in the furnace, nascent nitrogen forms and nitrides the workpiece. This is to be avoided in the subject method. The use of anhydrous ammonia as a diluent represents a practical and low cost approach.

In practice, the subject method as applied to a powder metal workpiece, to which this invention is specifically directed, is as follows: A typical ferrous metal powder contains extremely low amounts of carbon. In certain cases it is desired to produce steel parts having precise amounts of carbon such as in the case of gears which must have a sufficient amount of carbon to be wear resistant but not so much carbon than brittle phases are formed in the core metal during heat treatment. This requires precise control of carbon content. A low carbon powder metal is mixed with graphite to provide about the carbon content desired. This mixture is pressed into a green compact which is subsequently sintered. Sintering is carried out in an atmosphere consisting of a certain or predetermined ratio of the products of cracked methane and dissociated ammonia. Knowing the amount of carbon contained in the green compact and knowing the amount desired ultimately, the proper diluted atmosphere can be selected to provide, during normal sintering times and temperatures, an equilibrium condition which provides and/or maintains a desired final amount of carbon in the workpiece. Since the cracked methane is diluted with the nitrogen and hydrogen resulting from the dissociated ammonia, low amounts of carbon, or in other words a low carbon potential, is provided in the atmosphere so that precise amounts of carbon can be obtained by this method. This low carbon potential atmosphere is lower than has been possible heretofore. Further, it prevents oxidation because each separately generated gas is dry and of low dew point.

BRIEF DESCRIPTION OF THE DRAWING

The FIGURE shows a schematic combination endothermic gas generator and ammonia dissociator.

DESCRIPTION OF THE PREFERRED EMBODIMENT

In general this invention provides sintering and/or heat treating atmospheres for carbon level control and oxidation prevention. The invention makes use of blended, low dew point atmospheres during the heating, sintering, cooling and/or subsequent heat treatment of powder metal compacts or parts of ferrous-base or non-ferrous base compositions, which are carbide formers, so that the various levels of carbon are controlled, and at the same time the formation of metal oxides of active elemental constituents is prevented. Equipment is also described which simultaneously produces and controls the atmosphere in balance with the various levels of carbon desired in the resulting sintered or heat treated workpieces to provide definite ranges of composition.

Typical compositions are listed in Table I as obtained from the various volume blends of dissociated ammonia (25% nitrogen and 75% hydrogen) and endothermic cracked methane gas at 2.5 to one air/gas ratio (20% carbon monoxide, 38% hydrogen and 42% nitrogen).

Table I is derived for a furnace requirement of 2000 cubic feet per hour of gas atmosphere. It shows the flow scope readings for dissociated ammonia and for endothermic gas at the various percentages of each. It also shows the number of cubic feet of each constituent flowing into the furnace at the corresponding ratios of each type of gas.

It can be determined experimentally and by calculation what ratio dissociated ammonia to endothermic gas will produce the level of carbon monoxide and hydrogen that is in equilibrium with the chemistry of the desired product as indicated in Table II. Table II shows the resultant analysis of the atmosphere in a furnace for the various volume percentages of dissociated ammonia gas and endothermically cracked methane gas.

TABLE I

| Vol = 2000 C.F.H. | FLOW SCOPE READINGS | | | | |
|---|---|---|---|---|---|
| $CH_4$ | $NH_3$ | Endo | CO | $H_2$ | $N_2$ |
| 2000 × 90 % $NH_3$ | 1800 | 200 | 40 | 1426 | 534 |
| 2000 × 80 % $NH_3$ | 1600 | 400 | 80 | 1352 | 568 |
| 2000 × 70 % $NH_3$ | 1400 | 600 | 120 | 1272 | 602 |
| 2000 × 60 % $NH_3$ | 1200 | 800 | 160 | 1196 | 636 |
| 2000 × 50 % $NH_3$ | 1000 | 1000 | 200 | 1130 | 670 |
| 2000 × 40 % $NH_3$ | 800 | 1200 | 240 | 1056 | 704 |
| 2000 × 30 % $NH_3$ | 600 | 1400 | 280 | 982 | 738 |
| 2000 × 20 % $NH_3$ | 400 | 1600 | 320 | 908 | 772 |
| 2000 × 10 % $NH_3$ | 200 | 1800 | 360 | 834 | 806 |
| 2000 × 0 % $NH_3$ | 0 | 2000 | 400 | 760 | 840 |

TABLE II

| RATIO $NH_3$Endo | CONSTITUENT ANALYSIS (Percent) CO | $H_2$ | $N_2$ |
|---|---|---|---|
| 90/10 | 2 | 71.3 | 26.7 |
| 80/20 | 4 | 67.5 | 28.4 |
| 70/30 | 6 | 63.6 | 30.4 |
| 60/40 | 8 | 59.8 | 31.8 |
| 50/50 | 10 | 56.5 | 33.5 |
| 40/60 | 12 | 52.8 | 35.2 |
| 30/70 | 14 | 49.1 | 36.9 |
| 20/80 | 16 | 45.4 | 38.6 |
| 10/90 | 18 | 41.7 | 40.3 |
| 0/100 | 20 | 38.0 | 42.0 |

As a guide for some of the more typical alloys (percentages are by weight), it has been found that for alloys of 0.20% to 0.25% carbon and 0.70% to 0.90% manganese, about a 60/40 (by volume) ratio of dissociated ammonia to endothermic gas, which produces HN atmosphere of 8% CO, 59.8% $H_2$ and 31.8% $N_2$, gives a final part or workpiece composition of 0.22% carbon and 0.70%/0.90% manganese. For a desired 0.18% to 0.24% carbon and 1.10% to 1.40% manganese composition, this same gas ratio also provides carbon and manganese content within the above range with a final analysis of 0.21% carbon and 1.25% manganese. For a 0.35% typical carbon and for both manganese contents of 0.70% to 0.90% and 1.10% to 1.40% respectively, it was found that about 50% of each dissociated ammonia and endothermic gas at low dew point produced 0.35% carbon and also kept the manganese from oxidizing. For higher carbon contents of 0.60% and 0.85% carbon a ratio of about 40/60 and 20/80 of dissociated ammonia to endothermic gas in each case is preferred.

The preferred equipment for this method is a combination endothermic generator and ammonia dissociator as shown in the figure. The equipment includes two or more retorts 10 and 11 within a combustion chamber heated by burning gas or electric heating elements. One or more retorts crank an air to gas (methane) ratio of about 2.5 to 1, to produce endothermic gas, and one or more retorts dissociate ammonia. By suitable meters, the input to each retort is regulated to produce desired amounts of cracked endothermic gas constituents (20% CO, 38% $H_2$ and 42% $N_2$) and desired amounts of dissociated ammonia (25% $H_2$ and 75% $N_2$) from each of the separate retorts 10 and 11. The required output is mixed or blended to form a desired composition which will be used in equilibrium with the chemistry of the parts or workpiece to be sintered. To accomplish this the desired atmosphere is piped, as shown, to a sintering furnace.

The control of carbon level in the sintering process or during subsequent heat treatment, annealing or hardening of ferrous powder metal compacts, has long been a difficult and almost impossible task. It has become necessary to sinter and/or heat treat porous and/or solid compacted metal parts containing alloying elements which are prone to oxidation when heated in ordinary gaseous atmosphere. This is also true of steel parts which contain oxidation-prone elements.

Endothermic gas atmospheres are ordinarily both too high in carbon potential at low dew point and too low in decarburizing resistance at higher dew point to sinter the full range of powder metal pressed parts to meet the A.I.S.I. carbon steel compositions. It has therefore not been possible heretofore to control the carbon level of the lower range composition of carbon when high alloying element content of other elements prone to oxidation are included. Such principal elements may be manganese and chromium and there may be others to a lesser degree.

It has also been difficult to control the medium range carbon steel and/or alloy steel compositions, since the gas carbon potential in equilibrium with the desired medium composition ordinarily has a dew point too high to prevent oxidation of the alloying constituents.

At the high carbon level, the low dew point endothermic atmosphere is too potent in carburizing action to be in equilibrium with 0.7%, 0.8% and 0.9% carbon level compositions. Often times undesirable hard constituents such as cementite inclusions were formed. This caused brittle products and made machining difficult.

A predetermined ratio of constituent gas composition, to be in equilibrium with the desired composition of the sintered compact, has been used with success in accordance with this invention. In the cases of sintering compressed briquettes, which were used as preforms for hot forming structural mechanical components, of several alloy steel compositions, the exact carbon analysis of the steel grade was successfully controlled by using the subject invention. The alloying elements of high level manganese content for each of the materials was also controlled without oxidation of the manganese. This is accomplished, in accordance with this invention, by using an atmosphere for sintering in which the carbon potential is maintained in equilibrium with the desired carbon chemistry of the steel powder compact. The dew point is controlled at a low level by controlling the air and gas ratio, as well as the cracking temperature in the endothermic gas generator. The carbon potential is further controlled by adding a dry reducing gas, which does not contain significant amounts of oxygen, carbon dioxide or water vapor, to the low dew point endothermic cracked gas. Dissociated ammonia gas cracked to low dew point is used as the diluting constituent.

By using a straight low dew point endothermic gas atmosphere to sinter an A.I.S.I, 4023 type steel composition powder metal compacts, which contain 0.20 to 0.25% carbon and 0.70 to 0.90% manganese, a higher carbon content was found to result. The manganese content was found to be at the proper level but some oxidation occurred. By sintering in straight dissociated ammonia, a loss of carbon or decarburization was found to take place in the resulting preform or compact.

For example, the method of the invention, on the other hand, produced the following results. A ratio of 60% (by volume) of dissociated ammonia with 40% (by volume) of endothermic cracked gas at a low dew point produced an atmosphere that was in equilibrium with steel powder compacts of both A.I.S.I. 4023 and A.I.S.I. 1522, which contained 0.20 to 25% and 0.18 to 0.24% carbon, respectively. It was also found that each steel powder with 0.70 to 0.90% manganese and 1.10 to 1.40% manganese, respectively, could be sintered without oxidation in the above atmosphere at 2050° F. The composition of the atmosphere at 60/40 ratio was 8% (by volume) carbon monoxide, 59.8% hydrogen and 31.8% nitrogen. This blend gave consistent results as to composition on the surface and in the core of the parts over several runs. The dew point was determined to be at +20° F., which was that of the stacked endothermic gas. The carbon potential as determined by the steel grip strip method was 0.28% carbon.

Processing compacts of the same composition but with 0.35% carbon in the mix and at a ratio of about 50% (by volume) dissociated ammonia and 50% (by volume) endothermic gas gave resulting compositions of about 0.35% carbon after sintering at 2050° F. for a normal time. This shows that the resulting carbon can be raised by increasing the amount of endothermic gas and reducing the amount of ammonia in the treatment atmosphere. The manganese did not pick up oxygen. Sintering and/or heat treatment without oxidation can be accomplished by regulating the ratio of low dew point endothermic gas with dissociated ammonia as a dry diluent in accordance with this invention. At the same time the carbon level can be controlled by regulating the ratio of endothermic gas to dissociated ammonia, and additionally at the same time the dew point remains low so that oxidation of any active alloying elements present does not take place.

The control of low level carbon, as in carburizing grades of carbon or alloy steel compositions, is important to maintain tough core properties of densified powder metal preforms. Here the composition of the compacted and sintered preform must be held to narrow ranges of carbon content to obtain strong and ductile core properties in case-hardened parts.

Having described the invention, an exclusive property right is claimed therein as follows:

1. A method of sintering steel powder metal compacts, comprising:

combusting methane to form CO, $N_2$ and $H_2$ constituents, dissociating ammonia to form $N_2$ and $H_2$ constituents, blending the constituents together and subsequently introducing the blended constituents into a sintering environment containing the compact while heating the compact at sintering temperatures.

2. The method of claim 1 wherein the sintering is maintained for a period of time sufficient to establish an equilibrium condition between the mixed constituents of the methane and ammonia and the carbon content of the compact whereby carbon content is controlled.

3. The method of claim 1 wherein the desired carbon content is about 0.20% to 0.25%, the ammonia and methane are provided in a ratio by volume of about 60/40, and following dissociation and combustion of the gases, respectively, the resulting constituents are mixed together to provide the sintering atmosphere for the compact.

4. The method of claim 2 wherein the compact additionally include manganese.

5. The method of claim 1 wherein the desired carbon content is about 0.35% carbon, the ammonia and methane are provided in a ratio by volume of about 50/50 and following dissociation and combustion of the gases respectively, the resulting constituents are mixed together to provide the sintering atmosphere for the compact.

6. The method of claim 5 wherein the compact additionally includes manganese.

7. The method of claim 1 wherein the desired carbon content is about 0.60%, the ammonia and methane are provided in a ratio of about 40/60 and the following dissociation and combustion of the gases respectively, the resulting constituents are mixed together to provide the sintering atmosphere for the compact.

8. The method of claim 1 wherein the desired carbon content of the compact is about 0.85% and the overall ratio of ammonia to methane is about 20/80 and the following dissociation and combustion of the gases respectively, the resulting constituents are mixed together to provide the sintering atmosphere for the compact.

9. A method of sintering comprising:

providing an endothermic generator and an ammonia dissociator, passing a flow of methane into the generator and a flow of ammonia into the dissociator, regulating the flow of the two gases relative to each other, combusting the methane in the generator and dissociating the ammonia in the dissociator, providing a steel powder metal compact in a sintering environment, passing the combusted constituents out of the generator, passing the dissociated constituents out of the dissociator, mixing constituents together, and introducing the mixed constituents into the sintering environment of the compact.

10. The method of claim 9 wherein the compact is a steel alloy.

11. The method of claim 4 wherein:

the flow of the two gases relative to each other is regulated to provide a volume ratio of about 60/40, and the steel compact includes about 0.18% to 0.25% by weight carbon.

12. The method of claim 11 wherein the compact additionally includes manganese.

13. The method of claim 9 wherein:

the flow of the two gases relative to each other is regulated to provide a volume ratio of about 50/50, and the steel compact includes about 0.35% by weight carbon.

14. The method of claim 13 wherein the compact additionally includes manganese.

15. The method of claim 9 wherein the flow of the two gases relative to each other is regulated to provide a volume ratio of about 40/60, and the steel compact includes about 0.60% by weight carbon.

16. The method of claim 15 wherein the compact additionally includes manganese.

17. The method of claim 9 wherein:

the flow of the two gases relative to each other is regulated to provide a volume ratio of about 20/80, and the steel compact includes about 0.85% by weight carbon.

18. The method of claim 17 wherein the compact additionally includes manganese.

19. A method of sintering a steel powder metal compact, comprising:

combusting a hydrocarbon fuel gas to form CO, $N_2$ and $H_2$ constituents, dissociating ammonia to form $N_2$ and $H_2$ constituents, mixing the constituents of the methane and ammonia together in controlled amounts depending upon the desired carbon content of the compact, and subsequently introducing the mixed constituents into a sintering environment containing the compact while heating the compact at sintering temperatures.

20. A method of sintering comprising:

providing an endothermic generator and an ammonia dissociator, passing a flow of hydrocarbon fuel gas into the generator and a flow of ammonia into the dissociator, regulating the flow of the two gases relative to each other, combusting the hydrocarbon fuel gas in the generator and dissociating the ammonia in the dissociator, providing a powder metal compact in a sintering environment, mixing constituents resulting from the combustion of the hydrocarbon fuel gas with constituents resulting from the dissociation of the ammonia, the mixing being in predetermined relative amounts of the constituents, and introducing the mixed constituents into the sintering environment of the compact.

* * * * *